US005994655A

United States Patent [19]

Tsai

[11] Patent Number: 5,994,655

[45] Date of Patent: Nov. 30, 1999

[54] KEY SWITCH ASSEMBLY FOR A COMPUTER KEYBOARD

[76] Inventor: Huo-Lu Tsai, No. 126-1, Shui-Nan Rd., Pei-Tun Dist., Taichung City, Taiwan

[21] Appl. No.: 09/243,069

[22] Filed: Feb. 2, 1999

Related U.S. Application Data

[63] Continuation-in-part of application No. 09/031,414, Feb. 26, 1998, Pat. No. 5,878,872.

[51] Int. Cl.[6] ..... H01H 3/12; H01H 13/70

[52] U.S. Cl. ..... 200/344

[58] Field of Search ..... 200/5 A, 344, 200/345, 512–517; 361/680

[56] References Cited

U.S. PATENT DOCUMENTS

| | | | |
|---|---|---|---|
| 5,597,067 | 1/1997 | Yoneyama | 200/344 |
| 5,763,842 | 6/1998 | Tsai et al. | 200/5 A |
| 5,767,468 | 6/1998 | Tsai | 200/344 |
| 5,769,210 | 6/1998 | Tsai | 200/344 |
| 5,770,824 | 6/1998 | Tsai et al. | 200/344 X |
| 5,878,872 | 3/1999 | Tsai | 200/344 |
| 5,898,145 | 4/1999 | Su | 200/344 |

*Primary Examiner*—J. R. Scott
*Attorney, Agent, or Firm*—Merchant & Gould P.C.

[57] ABSTRACT

A key switch assembly includes a base board having an L-shaped slide retainer plate which defines a slide recess with the base board, and a pivot retainer unit. A membrane circuit layer is superimposed on the base board. A resilient layer is provided with an upright resilient member, and is superimposed on the membrane circuit layer. The membrane circuit layer and the resilient layer are formed with openings to permit extension of the slide retainer plate and the pivot retainer unit above the resilient layer. A scissors-type key cap support includes first and second support levers with intermediate portions that are coupled rotatably about a pivot axis. The first support lever has a lower portion retained pivotally on the base board by the pivot retainer unit. The second support lever has a slide shaft extending into the slide recess for slidable retention on the base board. A key cap is formed with a second pivot retainer unit for retaining pivotally an upper portion of the second support lever, and a second slide retainer unit for retaining slidably an upper portion of the first support lever. The key cap is biased upwardly by the upright resilient member, and is depressible to compress the resilient member.

9 Claims, 9 Drawing Sheets

KEY SWITCH ASSEMBLY FOR A COMPUTER KEYBOARD

CROSS REFERENCE TO RELATED APPLICATION

This application is a continuation-in-part (CIP) of U.S. patent application Ser. No. 09/031,414, filed on Feb. 26, 1998 now U.S. Pat. No. 5,878,872, the entire disclosure of which is incorporated herein by reference.

BACKGROUND OF THE INVENTION

1. Field of the Invention

The present invention relates to a key switch assembly for a computer keyboard, more particularly to a key switch assembly which has a relatively simple and stable structure with a reduced thickness.

2. Description of the Related Art

In U.S. patent application Ser. No. 09/031,414, now U.S. Pat. No. 5,878,872, the Applicant disclosed a key switch assembly which includes a base board, a membrane circuit layer, a resilient layer, a scissors-type key cap support, and a key cap. The base board is formed with a pair of upwardly projecting slide retainer plates, a pair of upwardly projecting pivot retainer plates, and a stop projection. Each of the slide retainer plates has a vertical portion and a lateral horizontal portion on a top end of the vertical portion. The membrane circuit layer and the resilient layer are superimposed in sequence on the base board, and are formed with aligned openings to permit extension of the slide retainer plates, the pivot retainer plates and the stop projection therethrough. The resilient layer is provided with an upright resilient member. The key cap support includes first and second support levers. The first support lever has a lower portion which is retained pivotally by the pivot retainer plates of the base board, and an upper portion which is retained slidably by a slide retainer unit of the key cap. The second support lever has a lower portion formed with a pair of outward slide shafts which are retained slidably by the slide retainer plates of the base board, and a pair of inward slide shafts, and an upper portion which is retained pivotally by a pivot retainer unit of the key cap. The inward slide shafts extend through the openings formed in the resilient layer and press against the membrane circuit layer. The key cap is biased upwardly by the resilient member.

It is found that the slide shafts on the lower portion of the second support lever are retained on the base board merely by virtue of the lateral horizontal portions of the pair of spaced-apart slide retainer plates of the base board. Thus, the engagement between the key cap support and the base board is not stable enough.

SUMMARY OF THE INVENTION

The main object of the present invention is to provide a key switch assembly which has a relatively simple and stable structure with a reduced thickness.

Accordingly, the key switch assembly of the present invention includes a base board, a membrane circuit layer, a resilient layer, a scissors-type key cap support and a key cap. The base board has a front part formed with a first slide retainer unit and a rear part formed with a first pivot retainer unit. The first slide retainer unit includes an L-shaped first slide retainer plate which projects upwardly from the base board. The first slide retainer plate has a vertical portion and a horizontal portion that extends forwardly from an upper end of the vertical portion, and defines a first slide recess with the base board. The first pivot retainer unit includes a spaced pair of pivot retainer plates which project upwardly from the base board. Each of the pivot retainer plates includes an upright portion and a rearwardly projecting portion on a top end of the upright portion. The first pivot retainer unit further includes a stop projection which projects upwardly from the base board and which is disposed between the pivot retainer plates. The stop projection is disposed posteriorly of the pivot retainer plates to define a clearance between the stop projection and rear sides of the upright portions of the pivot retainer plates. The rearwardly projecting portion of each of the pivot retainer plates forms a restricted entrance to the clearance. The base board is further formed with a first opening disposed immediately below and communicated with the first slide recess. The membrane circuit layer is superimposed on the base board, and is formed with a second opening for extension of the first slide retainer plate therethrough, and a set of third openings for extension of the pivot retainer plates and the stop projection therethrough. The membrane circuit layer has an electrical contact. The resilient layer is superimposed on the membrane circuit layer, and is provided with an upright resilient member. The resilient layer is formed with a fourth opening aligned with the second opening to permit extension of the first slide retainer plate therethrough, and a fifth opening aligned with the set of the third openings for extension of the pivot retainer plates and the stop projection therethrough. The fourth opening has a size larger than the first opening. The scissors-type key cap support includes first and second support levers with upper and lower portions, and intermediate portions that are coupled rotatably about a horizontal pivot axis. The first support lever has a U-shaped frame with two parallel arms and a transverse connecting portion interconnecting the parallel arms. The lower portion of the first support lever is formed with a pivot shaft which is forced into the clearance via the restricted entrance and which abuts turnably against the stop projection on the base board for pivotal retention on the base board about an axis of the clearance. The second support lever has a generally rectangular frame with parallel rods interconnecting the upper and lower portions of the second support lever. The lower portion of the second support lever is formed with an inner slide shaft which interconnects the parallel rods and which extends into the first slide recess of the base board for slidable retention on the base board. The lower portion of the second support lever is further formed with an opposite pair of outer slide shafts which project outwardly from the parallel rods. The outer slide shafts are disposed within the fourth opening of the resilient layer, and extend above the base board. The key cap has a bottom side formed with a second slide retainer unit for retaining slidably the upper portion of the first support lever, and a second pivot retainer unit for retaining pivotally the upper portion of the second support lever. The key cap is biased upwardly by the upright resilient member, and is depressible to compress the resilient member and permit the resilient member to contact the electrical contact and enable the membrane circuit layer to produce an electrical signal.

BRIEF DESCRIPTION OF THE DRAWINGS

Other features and advantages of the present invention will become apparent in the following detailed description of the preferred embodiments with reference to the accompanying drawings, in which.

DETAILED DESCRIPTION OF THE PREFERRED EMBODIMENTS

Figure 1:
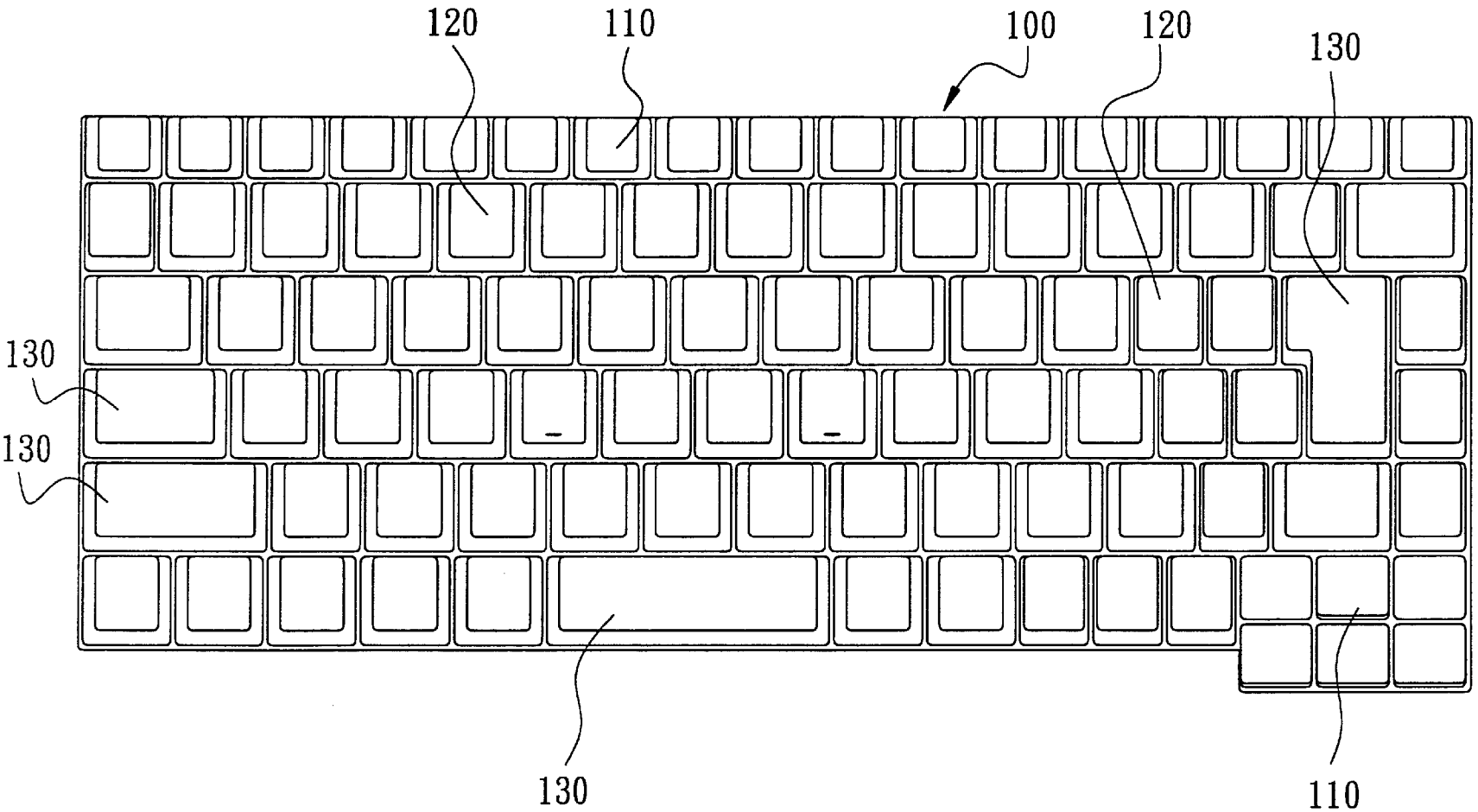
FIG. 1 is a top view of a computer key board incorporating a plurality of the preferred embodiments of a key switch assembly of the present invention.
Figure 2:
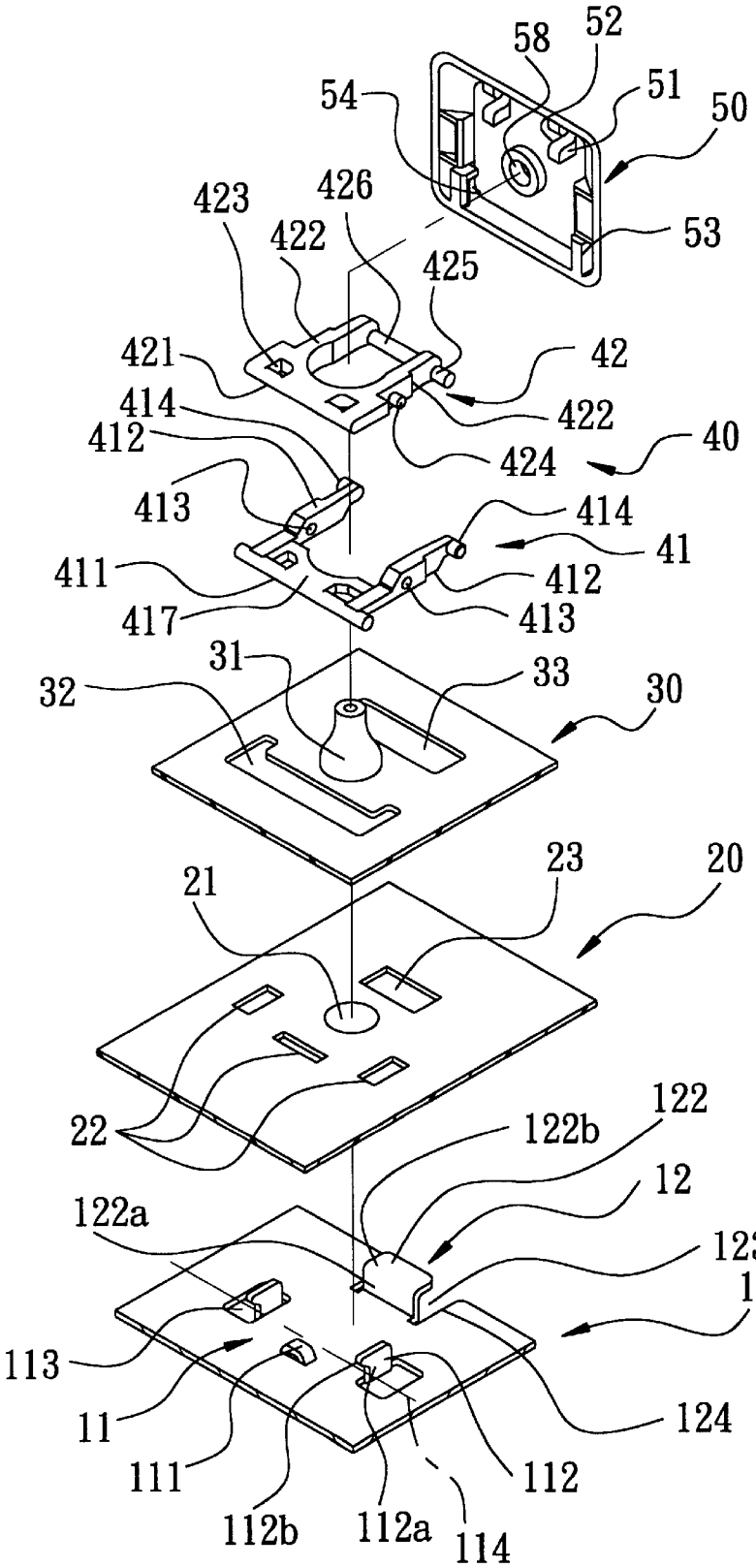
FIG. 2 is an exploded perspective view of a first preferred embodiment of the key switch assembly of the present invention.

Referring to FIGS. 1 and 2, the first preferred embodiment of a key switch assembly according to the present invention is applied to a switch key 110 which occupies a smaller area in a computer key board 100, such as a function key or a direction key, and is shown to include a base board 10, a membrane circuit layer 20, a resilient layer 30, a scissors-type key cap support 40 and a key cap 50.

The base board 10 has a front part formed with a first slide retainer unit 12, and a rear part formed with a first pivot retainer unit 11. The first slide retainer unit 12 includes an L-shaped first slide retainer plate 122 which is formed by punching and which projects upwardly from the base board 10. The slide retainer plate 122 has a vertical portion 122*a* and a horizontal portion 122*b* on a top end of the vertical portion 122*a* to define a slide recess 123 with the base board 10. The base board 10 is formed with a first opening 124 that is disposed immediately below the first slide recess 123 and that is communicated with the first slide recess 123. The first pivot retainer unit 11 is similarly formed by punching and includes a spaced pair of pivot retainer plates 112 which project upwardly from the base board 10, and a stop projection 111 which projects upwardly from the base board 10 and which is disposed between the pivot retainer plates 112. Each of the pivot retainer plates 112 includes an upright portion 112*a* and a rearwardly projecting portion 112*b* on a top end of the upright portion 112*a*. The stop projection 111 is disposed posteriorly of rear sides of the pivot retainer plates 112 to define a clearance 113 between the stop projection 111 and the pivot retainer plates 112. The rearwardly projecting portion 112*b* of each of the pivot retainer plates 112 forms a restricted entrance 113*a* (see FIG. 4) to the clearance 113. The clearance 113 has an axis 114. The first opening 124 has a length which is measured along a line parallel to the axis 114 and which is slightly larger than the length of the horizontal portion 122*b* of the first slide retainer plate 122.

Referring again to FIG. 2, the membrane circuit layer 20 is superimposed on the base board 10, and has an electrical contact 21. The membrane circuit layer 20 is formed with a second opening 23 for extension of the first slide retainer plate 122 therethrough, and a set of third openings 22 for extension of the pivot retainer plates 112 and the stop projection 111 therethrough. The second opening 23 has a length smaller than that of the first opening 124.

The resilient layer 30 is superimposed on the membrane circuit layer 20, and is provided with an upright resilient member 31 that is aligned with the electrical contact 21 of the membrane circuit layer 20. The resilient layer 30 is formed with an elongated fourth opening 33 aligned with the second opening 23 to permit extension of the first slide retainer plate 122 therethrough, and an elongated fifth opening 32 aligned with the set of third openings 22 for extension of the pivot retainer plates 112 and the stop projection 111 therethrough. The fourth opening 33 has a length larger than that of the second opening 23 so that a periphery of the second opening 23 is exposed via the fourth opening 33.

Figure 3:
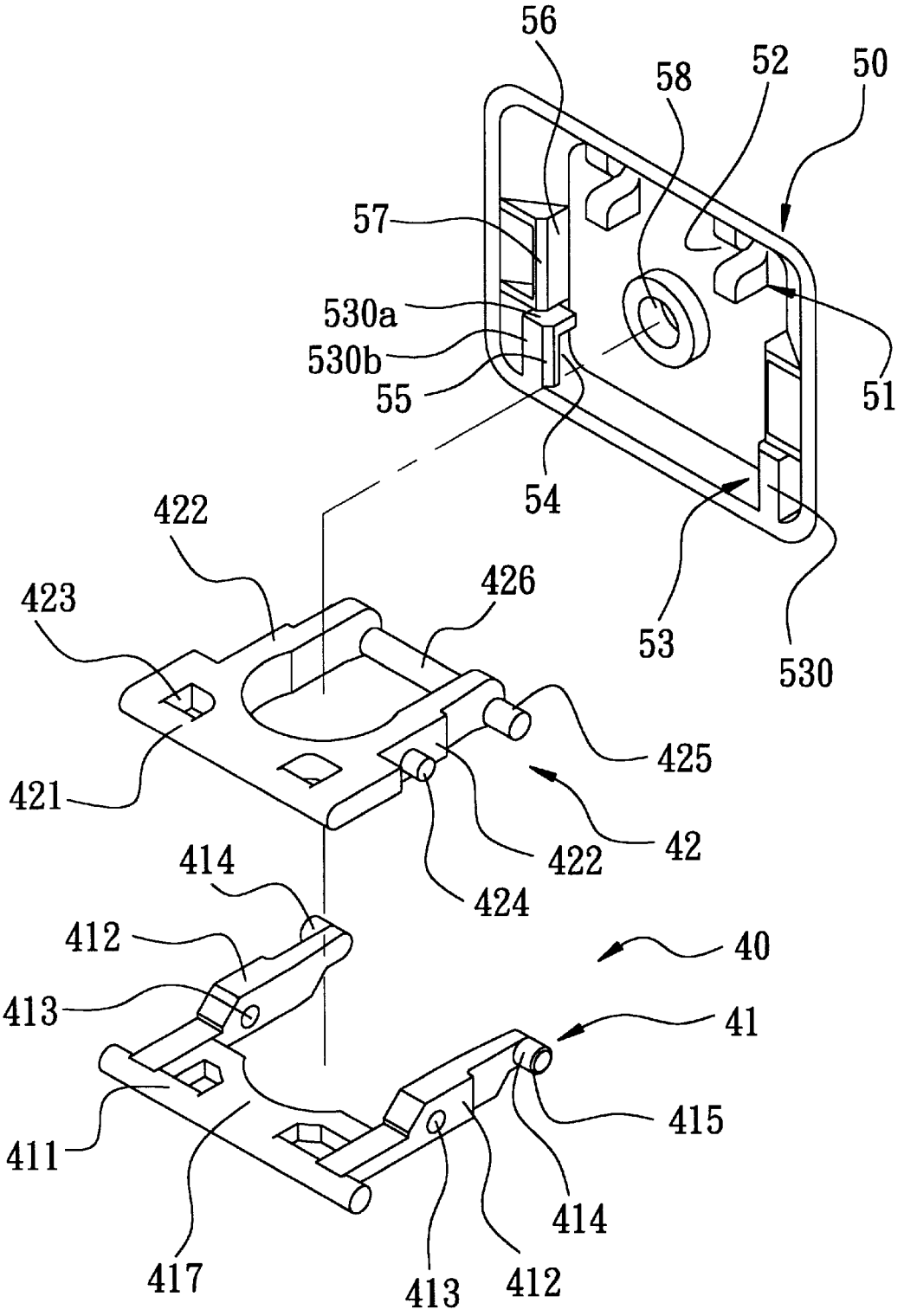
FIG. 3 is an enlarged exploded perspective view, illustrating a key cap support and a key cap of the key switch assembly of the first preferred embodiment.

Referring to FIGS. 2 and 3, the scissors-type key cap support 40 includes a first support lever 41 and a second support lever 42. The first support lever 41 has a U-shaped frame with two parallel arms 412 and a transverse connecting portion 417 interconnecting the parallel arms 412. A pivot shaft 411 is formed at a lower portion of the first support lever 41 adjacent to the transverse connecting portion 417 to interconnect the parallel arms 412. The pivot shaft 411 has two opposite ends which project outwardly from lower ends of the parallel arms 412. The pivot shaft 411 can be forced into the clearance 113 via the restricted entrances 113*a* (see FIG. 4) for pivotal retention on the base board 10 by the pivot retainer plates 112. The pivot shaft 411 further abuts turnably against a front side of the stop projection 111. The first support lever 41 has an upper portion formed with an opposite pair of slide shafts 414 which project outwardly from upper ends of the parallel arms 412. Each of the slide shafts 414 has a tapered end 415. The first support lever 41 further has an intermediate portion between the upper and lower portions and formed with an aligned pair of pin bores 413 on inner edges of the parallel arms 412.

Figure 5:
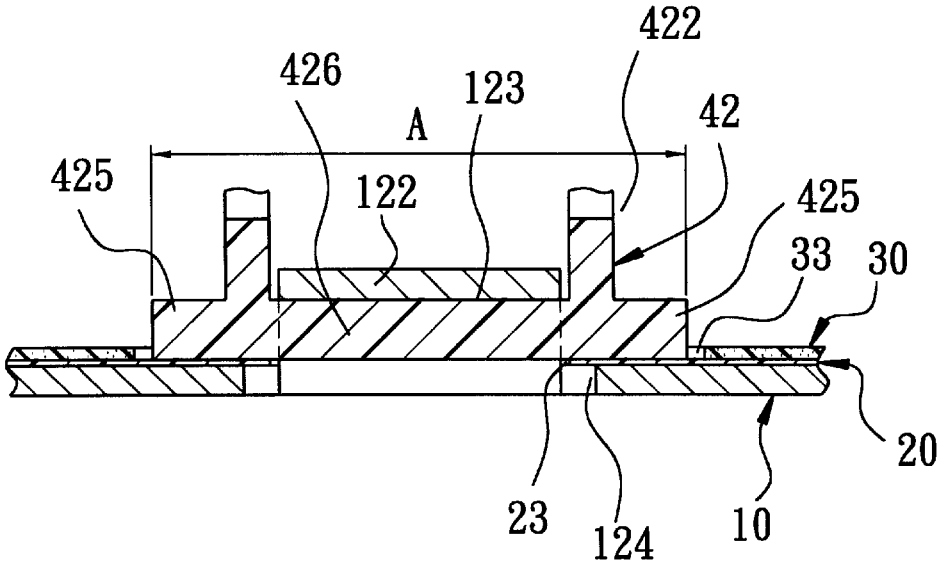
FIG. 5 is partly sectional view of the first preferred embodiment, taken along line V—V in FIG. 4.

The second support lever 42 has a generally rectangular frame with upper and lower portions and parallel rods 422 interconnecting the upper and lower portions. The parallel rods 422 have outer edges which are flanked by the inner edges of the parallel arms 412 of the first support lever 41. The lower portion of the second support lever 42 is formed with an opposite pair of outer slide shafts 425 which project outwardly from lower ends of the parallel rods 422, and an inner slide shaft 426 which interconnects the lower ends of the parallel rods 422. The inner slide shaft 426 extends into the first slide recess 123 for slidable retention on the base board 10 by the first slide retainer plate 122. The horizontal portion 122*b* of the first slide retainer plate 122 prevents disengagement of the inner slide shaft 426 from the slide recess 123. As shown in FIG. 5, the outer slide shafts 425 have outer ends which are displaced from each other by a distance (A) that is smaller than the length of the fourth opening 33 in the resilient layer 30, but larger than the length of the second opening 23 such that the outer slide shafts 425 are disposed within the fourth opening 33 and press against the membrane circuit layer 20 at the periphery of the second opening 22 to result in close contact between the membrane circuit layer 20 and the base board 10. Referring again to FIGS. 2 and 3, the upper portion of the second support lever 42 is formed with a transverse pivot portion 421 that interconnects the parallel rods 422. The second support lever 42 further has an intermediate portion formed with an aligned pair of tapered pins 424 on the outer edges of the parallel rods 422. Each of the tapered pins 424 tapers outwardly, and extends fittingly and rotatably into an adjacent one of the pin bores 413 in the first support lever 41 for coupling pivotally the intermediate portions of the first and second support levers 41, 42 thereabout. The transverse pivot portion 421 is formed with a pair of spaced-apart insert holes 423.

The key cap 50 has a bottom side formed with a second slide retainer unit 53 for retaining slidably the slide shafts 414 on the upper portion of the first support lever 41, and a second pivot retainer unit 51 for retaining pivotally the pivot portion 421 of the second support lever 42. The second slide retainer unit 53 includes a pair of spaced-apart second slide retainer plates 530, each of which includes a vertical wall 530*a* extending downwardly from the bottom side of the key cap 50 and a horizontal wall 530*b* connected to a lower end of the vertical wall 530*a* so as to cooperatively define a second slide recess 54 with the bottom side of the key cap 50. The second slide recess 54 of each of the second side retainer plates 530 opens in a direction toward the second slide recess 54 of the other one of the second slide retainer plates 530. The horizontal wall 530*b* of each of the second slide retainer plates 530 has a chamfered guiding edge 55 formed adjacent to an entrance of the respective second slide recess 54. The second pivot retainer unit 51 extends into the insert holes 423 and is formed with a pair of pivot recesses 52 for retaining pivotally the pivot portion 421 of the second support lever 42. The bottom side of the key cap 50 is formed with an opposite pair of vertical limiting walls 56 on two lateral sides. Each of the vertical limiting walls 56 has a chambered bottom edge 57. The bottom side of the key cap 50 is further formed with a positioning hole 58 at a central portion thereof to permit extension of an upper end of the resilient member 31 thereinto for positioning the resilient member 31. The key cap 50 is biased upwardly by the resilient member 31, and is depressible to compress the resilient member 31 and permit the resilient member 31 to contact the electrical contact 21 and enable the membrane circuit layer 20 to produce an electrical signal. When the key cap 50 is depressed, the vertical limiting walls 56 flank outer edges of the parallel arms 412 of the first support lever 41 at the intermediate portion of the latter.

Figure 4:
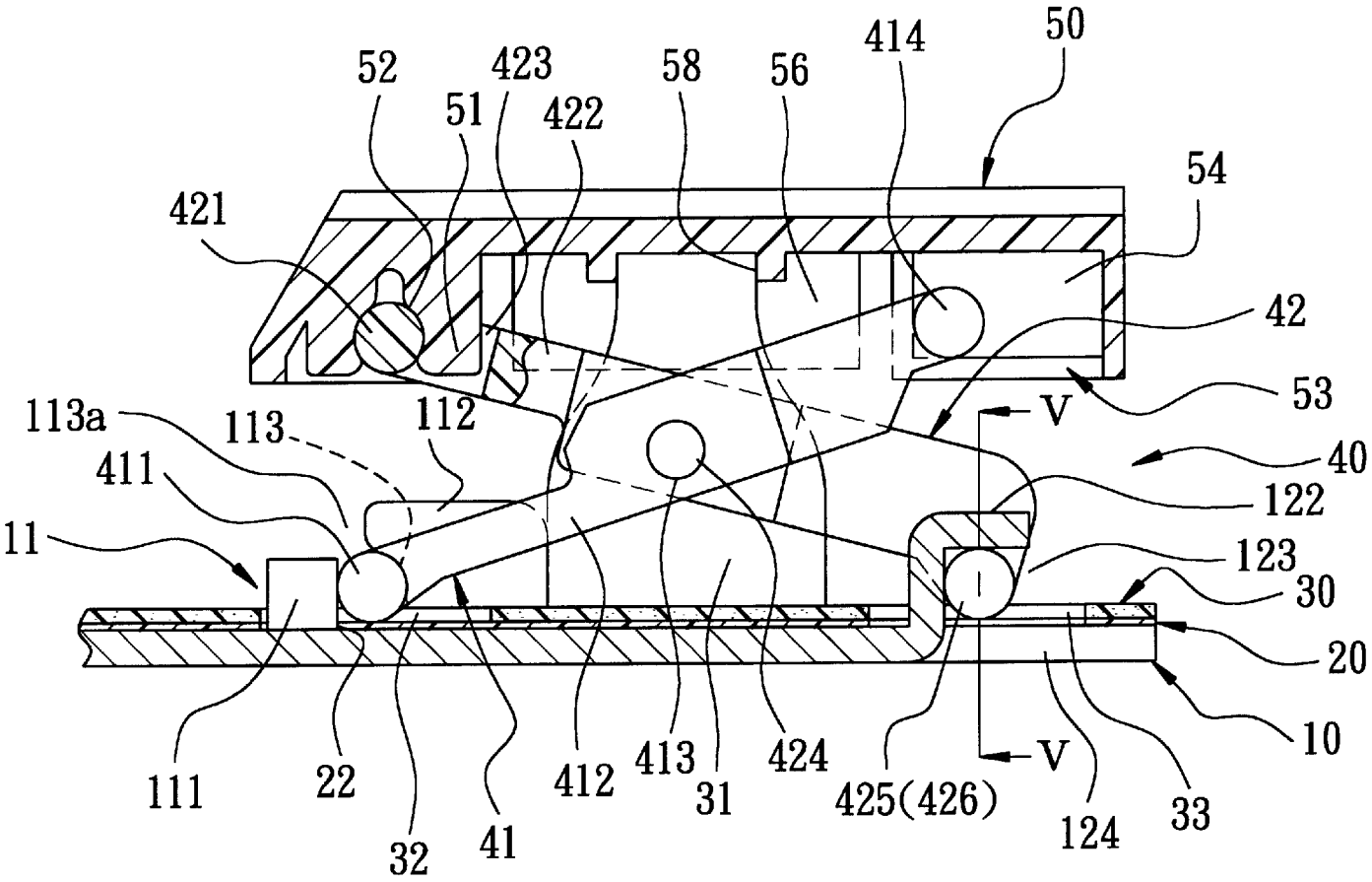
FIG. 4 is a vertical sectional view of the first preferred embodiment, where the key cap thereof is shown to be in a non-depressed position.

Referring to FIGS. 4 and 5, after assembly, the membrane circuit layer 20 is superimposed on the base board 10, and the resilient layer 30 is superimposed on the membrane circuit layer 20. The first slide retainer plate 122, the pivot retainer plates 112 and the stop projection 111 extend above the resilient layer 30 via the openings 23, 33, 22, 32 so that the pivot shaft 411 of the first support lever 41 can be extended into the clearance 113 between the stop projection 111 and the rear sides of the pivot retainer plates 112, and so that the inner slide shaft 426 of the second support lever 42 can be extended into the first slide recess 123. The outer slide shafts 425 are disposed within the fourth opening 33 of the resilient layer 30 to press against the membrane circuit layer 20 at a periphery of the second opening 23. The pivot shaft 411 of the first support lever 41 is disposed within the fifth opening 32 of the resilient layer 30 to press against the membrane circuit layer 20. Therefore, the membrane circuit layer 20 and the base board 10 can be in close contact with each other so as to prevent entry of dust from between the membrane circuit layer 20 and the base board 10 and prevent adverse affects to the conductivity of the membrane circuit layer 20. This is especially helpful since the smaller key 110 is typically arranged at a periphery of the key board 100.

Referring to FIG. 3, during assembly of the key switch assembly of the present embodiment, the tapered ends 415 of the slide shafts 414 of the first support lever 41 slide past the chamfered guiding edges 55 of the second slide retainer plates 530 of the key cap 50 to permit the slide shafts 414 to extend respectively into the second slide recesses 54 for slidable retention on the second slide retainer unit 53 of the key cap 50. The pivot portion 421 on the upper portion of the second support lever 42 is retained rotatably in the second pivot retainer unit 52 of the key cap 50. The upright resilient member 31 extends into the positioning hole 58 of the key cap 50, and biases the key cap 50 upwardly to maintain the key cap 50 at a predetermined height.

Figure 6:
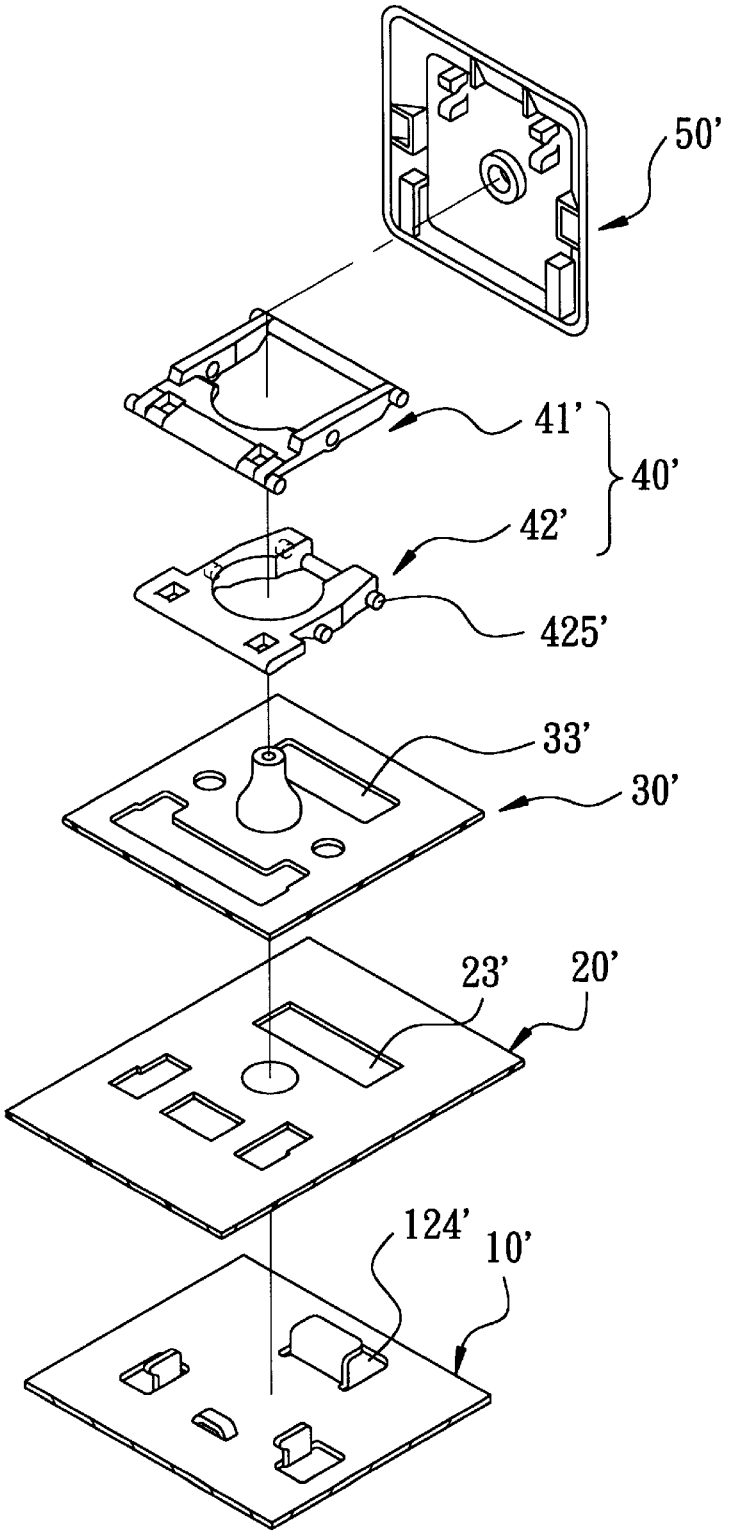
FIG. 6 is an exploded perspective view of a second preferred embodiment of the key switch assembly of the present invention.
Figure 7:
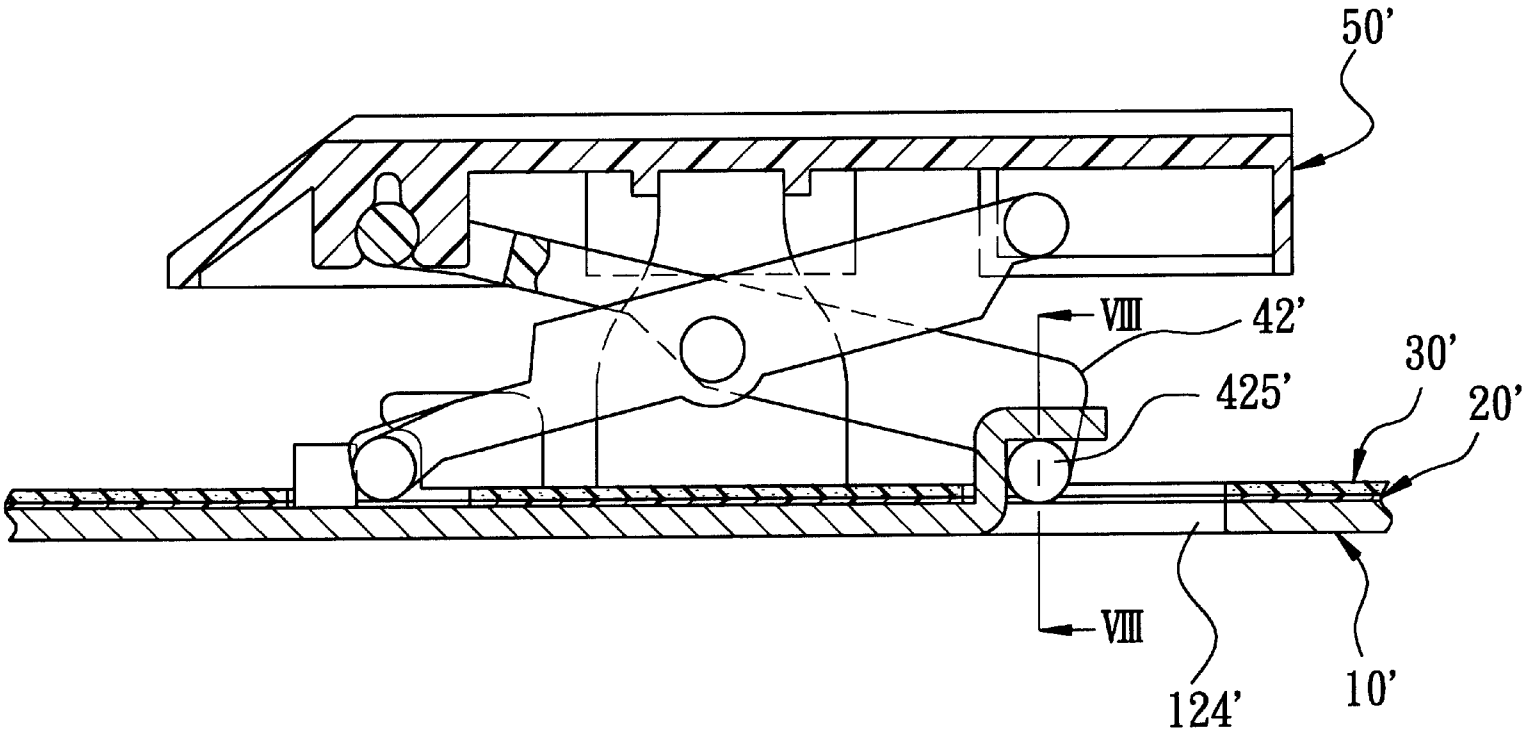
FIG. 7 is a vertical sectional view of the second preferred embodiment, where a key cap thereof is shown to be in a non-depressed position.
Figure 8:
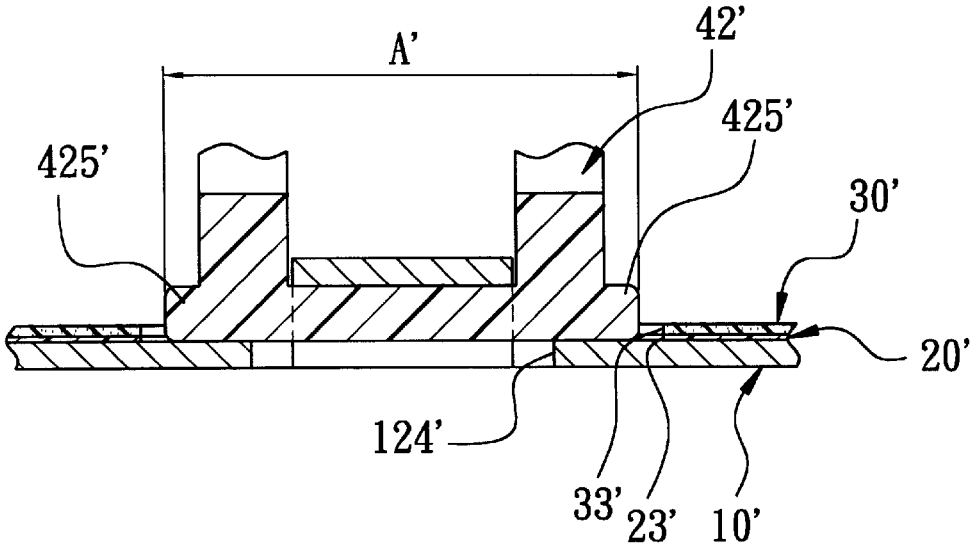
FIG. 8 is partly sectional view of the second preferred embodiment, taken along line VIII—VIII in FIG. 7.

Referring to FIGS. 1 and 6, the second preferred embodiment of the key switch assembly of the present invention is applied to a switch key 120 which has a size larger than the switch key 110, such as number and character keys, and is shown to also include a base board 10', a membrane circuit layer 20', a resilient layer 30', a scissors-type key cap support 40' including first and second support levers; 41', 42', and a key cap 50'. The present embodiment differs from the previous embodiment in that, with further reference to FIGS. 7 and 8, a distance (A') between outer ends of outer slide shafts 425' of the second support lever 42' is smaller than a second opening 23' formed in the membrane circuit layer 20' such that the outer slide shafts 425' are disposed within the second opening 23' and press against the base board 10' at a periphery of a first opening 124' formed in the base board 10'.

Figure 9:
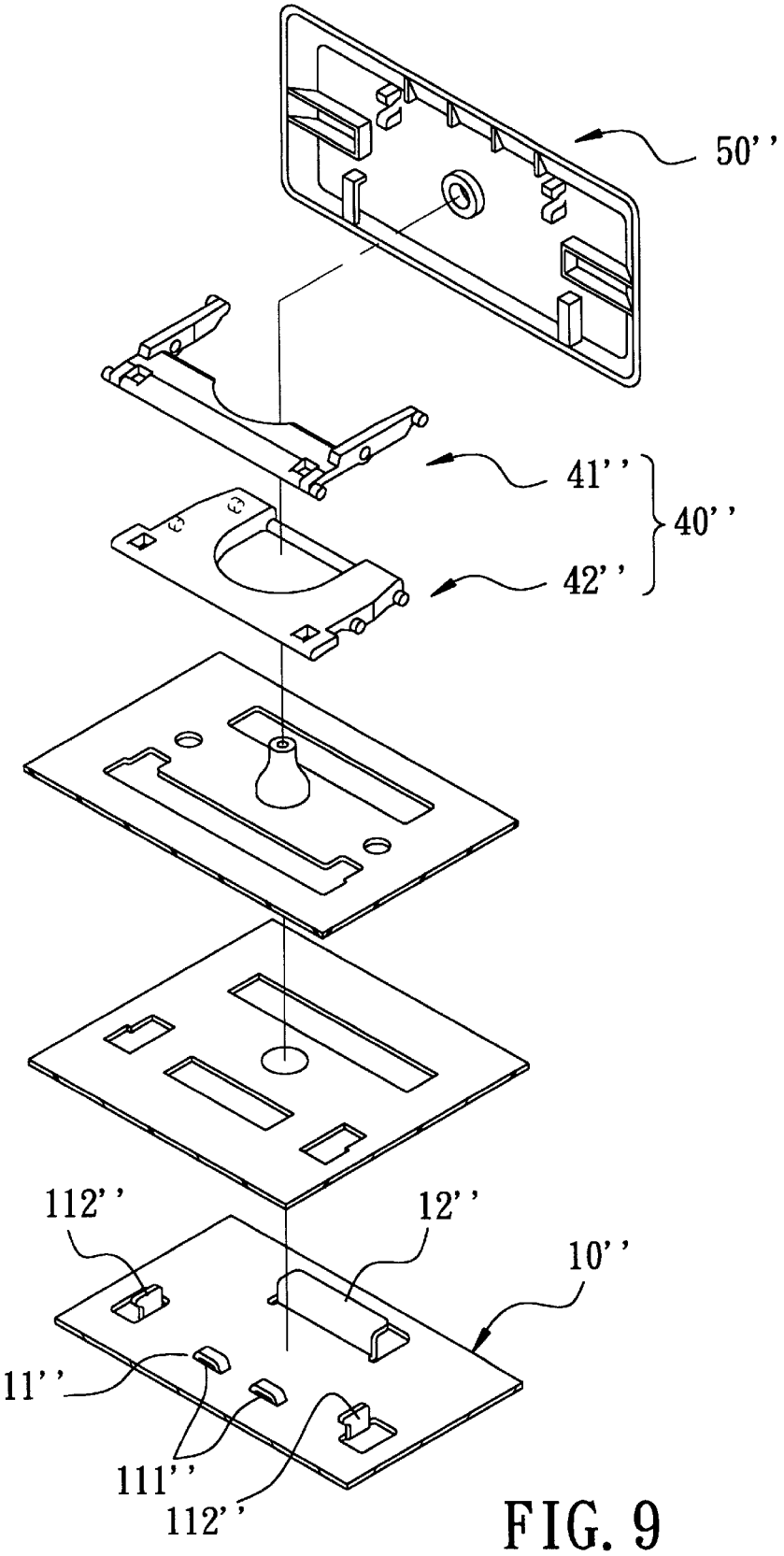
FIG. 9 is an exploded perspective view of a third preferred embodiment of the key switch assembly of the present invention.

Referring to FIGS. 1 and 9, the third preferred embodiment of the key switch assembly of the present invention is applied to a switch key 130 which has a larger size, such as a spacebar or an "Enter" key, and has a structure similar to that of the previous embodiment. The present embodiment differs from the previous embodiment in that each of the key cap 50", the first and second support levers 41", 42" of the key cap support 40", and the first slide retainer unit 12" of the base board 10" is much longer than those in the previous embodiment, and in that the first pivot retainer unit 11" of the base board 10" includes a pair of pivot retainer plates 112" and a pair of stop projections 111" disposed between the pivot retainer plates 112" for retaining the lower portion of the first support lever 41" which has a longer length.

It has been shown that, by virtue of the engagement between the inner slide shaft 426 and the L-shaped first slide retainer plate 122, the second support lever 42 (42', 42") of the key cap support 40 (40', 40") can be more stably retained on the base board 10 (10', 10") to result in enhanced structural stability of the entire key switch assembly.

With this invention thus explained, it is apparent that numerous modifications and variations can be made without departing from the scope and spirit of this invention. It is therefore intended that this invention be limited only as indicated in the appended claims.

I claim:

1. A key switch assembly for a computer keyboard, said key switch assembly comprising:

a base board having a front part formed with a first slide retainer unit and a rear part formed with a first pivot retainer unit, said first slide retainer unit including an L-shaped first slide retainer plate which projects upwardly from said base board, said first slide retainer plate having a vertical portion and a horizontal portion that extends forwardly from an upper end of said vertical portion, said first slide retainer plate defining a first slide recess with said base board, said first pivot retainer unit including a spaced pair of pivot retainer plates which project upwardly from said base board, each of said pivot retainer plates including an upright portion and a rearwardly projecting portion on a top end of said upright portion, said first pivot retainer unit further including a stop projection which projects upwardly from said base board and which is disposed between said pivot retainer plates, said stop projection being disposed posteriorly of said pivot retainer plates to define a clearance between said stop projection and rear sides of said upright portions of said pivot retainer plates, said rearwardly projecting portion of each of said pivot retainer plates forming a restricted entrance to said clearance, said base board being further formed with a first opening disposed immediately below and communicated with said first slide recess;

a membrane circuit layer superimposed on said base board and formed with a second opening for extension of said first slide retainer plate therethrough, and a set of third openings for extension of said pivot retainer plates and said stop projection therethrough, said membrane circuit layer having an electrical contact;

a resilient layer superimposed on said membrane circuit layer and provided with an upright resilient member, said resilient layer being formed with a fourth opening aligned with said second opening to permit extension of said first slide retainer plate therethrough, and a fifth opening aligned with the set of said third openings for extension of said pivot retainer plates and said stop projection therethrough, said fourth opening having a size larger than said first opening;

a scissors-type key cap support including first and second support levers with upper and lower portions, and intermediate portions that are coupled rotatably about a horizontal pivot axis, said first support lever having a U-shaped frame with two parallel arms and a transverse connecting portion interconnecting said parallel arms, said lower portion of said first support lever being formed with a pivot shaft which is forced into said clearance via said restricted entrance and which abuts turnably against said stop projection on said base board for pivotal retention on said base board about an axis of said clearance, said second support lever having a generally rectangular frame with parallel rods interconnecting said upper and lower portions of said second support lever, said lower portion of said second support lever being formed with an inner slide shaft which interconnects said parallel rods and which extends into said first slide recess of said base board for slidable retention on said base board, said lower portion of said second support lever being further formed with an opposite pair of outer slide shafts which project outwardly from said parallel rods, said outer slide shafts being disposed within said fourth opening of said resilient layer and extending above said base board; and a key cap having a bottom side formed with a second slide retainer unit for retaining slidably said upper portion of said first support lever, and a second pivot retainer unit for retaining pivotally said upper portion of said second support lever, said key cap being biased upwardly by said upright resilient member and being depressible to compress said resilient member and permit said resilient member to contact said electrical contact and enable said membrane circuit layer to produce an electrical signal.

2. The key switch assembly according to claim 1, wherein each of said first, second and fourth openings has a length measured along a line parallel to the pivot axis of said key cap support, said outer slide shafts of said second support lever having outer ends which are displaced from each other by a distance that is smaller than the length of said fourth opening and that is larger than the length of said first opening.

3. The key switch assembly according to claim 2, wherein said distance is larger than the length of said second opening, said pair of outer slide shafts of said second support lever extending above said membrane circuit layer and pressing against said membrane circuit layer to result in close contact between said membrane circuit layer and said base board.

4. The key switch assembly according to claim 2, wherein said distance is smaller than the length of said second opening, said outer slide shafts being disposed within said second opening and pressing against said base board.

5. The key switch assembly according to claim 1, wherein said upper portion of said first support lever is formed with an opposite pair of slide shafts which project respectively from said parallel arms, each of said slide shafts having a tapered distal end, said second slide retainer unit of said key cap including an opposite pair of second slide retainer plates, each of said second slide retainer plates having a vertical wall that extends downwardly from said bottom side of said key cap and a horizontal wall connected to said vertical wall, said vertical wall and said horizontal wall cooperatively defining a second slide recess with said bottom side of said key cap, said horizontal wall having a chamfered guiding edge adjacent to said second slide recess, said tapered end of each of said slide shafts sliding past said chamfered guiding edge of said horizontal wall of a respective one of said second slide retainer plates so as to be guided into said second slide recess.

6. The key switch assembly as claimed in claim 1, wherein said parallel rods of said second support lever have outer edges, said parallel arms of said first support lever having inner edges that flank said outer edges of said second support lever, said intermediate portion of said second support lever being formed with an aligned pair of tapered pins on said outer edges, said tapered pins tapering outwardly, said intermediate portion of said first support lever being formed with an aligned pair of pin bores on said inner edges, each of said tapered pins extending fittingly and rotatably into a respective one of said pin bores for coupling pivotally said intermediate portions of said first and second support levers.

7. The key switch assembly as claimed in claim 6, wherein said parallel arms of said first support lever further have outer edges opposite to said inner edges thereof, said bottom side of said key cap being formed with an opposite pair of vertical limiting walls that flank said outer edges of said parallel arms of said first support lever at said intermediate section when said key cap is depressed.

8. The key switch assembly as claimed in claim 1, wherein said resilient member has an upper end, said bottom side of said key cap being formed with a positioning hole which permits extension of said upper end of said resilient member thereinto for positioning said resilient member.

9. The key switch assembly as claimed in claim 1, wherein said pivot shaft of said first support lever is disposed within said fifth opening of said resilient layer and presses against said membrane circuit layer to result in close contact between said membrane circuit layer and said base board.

* * * * *